US006752206B2

(12) United States Patent
Watson et al.

(10) Patent No.: US 6,752,206 B2
(45) Date of Patent: Jun. 22, 2004

(54) SAND CONTROL METHOD AND APPARATUS

(75) Inventors: Graham Watson, Houston, TX (US); Geoffrey R. Kernick, Aberdeen (GB); Colin J. Price-Smith, Missouri City, TX (US); Mehmet Parlar, Sugar Land, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 0 days.

(21) Appl. No.: 09/910,626

(22) Filed: Jul. 20, 2001

(65) Prior Publication Data

US 2002/0033259 A1 Mar. 21, 2002

Related U.S. Application Data

(60) Provisional application No. 60/222,862, filed on Aug. 4, 2000.

(51) Int. Cl.[7] ..... E21B 43/04

(52) U.S. Cl. ..... 166/278; 166/228; 166/51

(58) Field of Search ..... 166/228, 278, 166/376, 377, 51, 205, 222, 236, 289, 242.3

(56) References Cited

U.S. PATENT DOCUMENTS

| | | | | | |
|---|---|---|---|---|---|
| 2,155,129 | A | * | 4/1939 | Hall et al. | 138/118 |
| 2,297,308 | A | * | 9/1942 | Layne | 166/114 |
| 2,727,575 | A | * | 12/1955 | Abendroth | 166/131 |
| 2,927,640 | A | * | 3/1960 | Kenneday | 166/205 |
| 3,072,204 | A | * | 1/1963 | Brown | 166/120 |
| 3,134,439 | A | * | 5/1964 | Shields, Jr. | 166/143 |
| 3,301,329 | A | * | 1/1967 | Martin | 166/117 |
| 3,358,764 | A | * | 12/1967 | Parker | 166/280 |
| 3,709,298 | A | * | 1/1973 | Pramann | 166/276 |
| 4,192,375 | A | * | 3/1980 | Maly et al. | 166/128 |
| 4,428,428 | A | * | 1/1984 | Smyrl et al. | 166/278 |
| 4,685,519 | A | * | 8/1987 | Stowe et al. | 166/278 |
| 4,945,991 | A | | 8/1990 | Jones | |
| 5,082,052 | A | | 1/1992 | Jones et al. | |
| 5,113,935 | A | | 5/1992 | Jones et al. | |
| 5,161,613 | A | | 11/1992 | Jones | |
| 5,161,618 | A | | 11/1992 | Jones et al. | |
| 5,219,025 | A | * | 6/1993 | Berger et al. | 166/278 |
| 5,333,688 | A | | 8/1994 | Jones et al. | |
| 5,373,899 | A | * | 12/1994 | Dore' et al. | 166/278 |
| 5,394,938 | A | * | 3/1995 | Cornette et al. | 166/205 |
| 5,507,346 | A | * | 4/1996 | Gano et al. | 166/242.1 |
| 5,515,915 | A | | 5/1996 | Jones et al. | |
| 5,842,516 | A | | 12/1998 | Jones | |
| 5,842,518 | A | * | 12/1998 | Soybel et al. | 166/241.6 |
| 5,890,533 | A | | 4/1999 | Jones | |
| 6,003,600 | A | * | 12/1999 | Nguyen et al. | 166/276 |
| 6,070,663 | A | * | 6/2000 | Cernocky et al. | 166/242.2 |
| 6,220,345 | B1 | | 4/2001 | Jones et al. | |
| 6,227,303 | B1 | | 5/2001 | Jones | |
| 6,298,916 | B1 | | 10/2001 | Tibbles et al. | |
| 6,382,319 | B1 | * | 5/2002 | Hill et al. | 166/194 |

* cited by examiner

*Primary Examiner*—David Bagnell
*Assistant Examiner*—Daniel P Stephenson
(74) *Attorney, Agent, or Firm*—Williams, Morgan & Amerson, P.C.; Jeffrey E. Griffin; Brigitte Jeffery Echols

(57) ABSTRACT

The present invention discloses a system using a conduit run into a well on a service string. In one embodiment the conduit includes outlets along its length to permit a sand control treatment to exit the conduit along the length of the conduit and distribute the sand control treatment along the length of the conduit. The conduit can have a plurality of such outlets spaced to provide an even distribution of the sand control treatment. The conduit can be attached to the delivery tubing (such as coiled tubing or service string tubing) via a releasable connector. The conduit is deployed on the delivery tubing and connector (and is in fluid communication therewith) in the well adjacent to an area to be treated. The sand control treatment is pumped into the well. Once the sand control treatment is complete, the releasable connector is released to disconnect the conduit from the delivery tubing and the delivery tubing is removed from the well.

13 Claims, 4 Drawing Sheets

SAND CONTROL METHOD AND APPARATUS

CROSS-REFERENCE TO RELATED APPLICATIONS

This application claims benefit of U.S. Provisional Application No. 60/222,862 filed on Aug. 4, 2000.

BACKGROUND OF THE INVENTION

1. Field of the Invention

The present invention relates to the field of wells. More specifically, the invention relates to a device and method for providing sand control within a well.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Sand or silt flowing into the wellbore from unconsolidated formations can lead to an accumulation of fill within the wellbore, reduced production rates and damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flowlines, valves and processing equipment. The loss of material from the reservoir matrix can also lead to the movement and possible collapse of the reservoir. The problems caused by sand production and the deterioration of the reservoir support matrix can significantly increase operational and maintenance expenses and can lead to a total loss of the well.

One means of controlling sand production is the placement of relatively large grain sand or resin beads, referred hereafter as "gravel", within the perforation tunnels and/or the reservoir matrix. The gravel serves to consolidate and prevent the movement of failed sandstone and/or increase the compressive strength of the formation sand. It can also serve as a filter to help assure that formation fines and formation sand do not migrate with the produced fluids into the wellbore. In a typical gravel pack completion, gravel is mixed with a carrier fluid and is pumped in a slurry mixture through a conduit, often coiled tubing, into the wellbore. The carrier fluid in the slurry leaks off into the formation or is returned to the surface through a separate tubular or an annulus area, leaving the gravel deposited in the formation, perforation tunnels and wellbore where it forms a gravel pack. Gravel pack treatments typically include the running of a sand screen into the well prior to the gravel pack operation, but does not have to.

Other sand control methods include sand consolidation treatments that involve the use of a resin material. One method involves sand or gravel that is pre-coated with resin and is then pumped into the wellbore. The heat within the wellbore causes the resin to cure, thus joining the gravel together and forming a consolidated gravel plug. The consolidated gravel plug acts as a filter to restrict formation sand production and thereby stabilize the reservoir. An alternate method involves pumping sand and resin into the well where they mix and cure to form a consolidated sand plug. Yet another method involves pumping resin only into the formation, thereby forming an in-situ consolidation of the formation sand that stabilizes the reservoir. In methods that produce a consolidated sand plug within the wellbore, the sand plug can then be drilled out to open the wellbore for production and/or tubulars. The sand consolidation methods described above typically do not include a sand screen during the treatment. A sand screen can be is inserted within the wellbore after the consolidated sand plug is drilled out.

A problem that is frequently encountered in a sand control operation, especially in long or highly deviated sections or formations with high permeability, is the formation of gravel bridges within the wellbore. Non-uniform gravel distribution within the wellbore often occurs as a result of the premature loss of carrier fluid from the slurry. The fluid can be lost into high permeability zones within the formation, leading to the creation of gravel bridges in the wellbore, before all the gravel has been placed. These gravel bridges will restrict the flow of slurry in the wellbore and result in voids within the completion zone needing sand control. Effective control of formation sand during production requires complete coverage of the perforated interval. Voids within the sand control treatment allow formation sand and fines to be carried out of the reservoir matrix with the produced fluids and can lead to the problems mentioned above.

Once gravel bridging within the wellbore has occurred and the sand control operation is terminated, remedial treatments will need to be conducted for those sections that did not get an adequate gravel placement or consolidation treatment. This often includes multiple trips to drill out the gravel bridge so that subsequent sand control treatments can be performed, until a suitable treatment has been obtained through the entire zone of completion. This multiple trip approach increases the time and expense of completing the well, and also increases the risk of encountering wellbore problems, such as losing tools or becoming stuck.

Thus, despite the use of the prior art features, there remains a need for a sand control system and method that prevents or reduces the creation of gravel bridges and voids during a sand control completion of a wellbore.

SUMMARY OF THE INVENTION

To achieve such improvements, the present invention provides a system using a conduit run into a well on a service string. In one embodiment the conduit includes outlets along its length to permit the gravel slurry to exit the conduit along the length of the conduit and distribute the gravel slurry the full length of the conduit. The conduit can have a plurality of such outlets spaced to provide an even distribution of the sand control treatment and reduce the aforementioned problems. The conduit is attached to the delivery tubing (coiled tubing or service string tubing) via a releasable connector. The conduit is deployed on the delivery tubing and connector (and is in fluid communication therewith) in the well adjacent the area to be gravel packed. The gravel slurry is pumped into the well. Once the treatment is complete, the releasable connector is released to disconnect the conduit from the delivery tubing and the delivery tubing is removed from the well.

One embodiment of the present invention is a gravel pack system comprising a conduit having a plurality of outlets along its length, a delivery tubing extending to a well surface and a releasable connector releasably connecting the conduit to the delivery tubing. The conduit and the delivery tubing are in fluid communication. The conduit outlets can comprise perforations within the conduit, and can contain nozzles extending into the conduit. The conduit can also have baffle elements within its interior. The nozzles and baffle elements increase the pressure drop and turbulence that exists during a gravel pack operation and decrease the likelihood of gravel bridging within the conduit. To ease the drilling out of the conduit after the gravel pack operation is complete, the conduit can be made of an easily drillable material. It can also be made of a composite material.

Another embodiment is a sand control tool comprising a tubular conduit having a plurality of apertures along its length, the apertures capable of passing a gravel pack slurry, the tool being releasably connected to and in fluid communication with a work string. The apertures can contain nozzles having a known opening size. The tubular conduit can be made of an easily drillable material and can comprise baffle elements within its interior.

An alternate embodiment is a sand control system for completing a wellbore. The system includes a distribution tool comprising at least one conduit providing a plurality of outlets along the distribution tool length. A delivery tubing extends to a well surface and the distribution tool is in fluid communication with the delivery tubing. A releasable connector can be used to releasably connect the distribution tool to the delivery tubing. The distribution tool can be made of an easily drillable material. The distribution tool can comprise a plurality of flow paths through the distribution tool to differing depths within the wellbore. The distribution tool can comprise a plurality of concentric tubulars forming a plurality of flow paths to differing depths within the wellbore.

Yet another embodiment of the invention is a method for gravel packing a well. The method comprises extending a conduit having a plurality of outlets along its length in a well adjacent to a portion of the well to be gravel packed. The conduit is releasably attached to a delivery tubing. A gravel pack is pumped through the plurality of outlets into the well and the conduit is released from the delivery tubing. Excess gravel can be circulated out of the well through the delivery tubing after releasing the conduit from the delivery tubing. At least a portion of the conduit and gravel pack can be removed from the well by drilling or breaking the conduit into a plurality of sections. Some of the conduit outlets may contain nozzles that provide an increased pressure drop as the gravel pack is pumped through the conduit outlets. The conduit can be released from the delivery tubing by the rupture of a shear element, by actuating a mechanical J-slot tool or by a mechanical ball drop release mechanism.

Still another embodiment is a method of completing a well comprising pumping a gravel slurry through a perforated conduit. A perforated conduit can be placed at a predetermined location within the well the perforated conduit being attached to a work string with a releasable connector, the two being released from each other after pumping the gravel slurry. The perforated conduit can be drilled out after the release of the perforated conduit from the work string.

One particular embodiment is a method of inhibiting bridge formation during the completion of a well. The method comprises inducing an elevated pressure drop across a perforated conduit while pumping a sand control treatment. The perforated conduit can comprise nozzles located within the perforations and extending into the conduit and/or baffles within its interior to induce turbulence while pumping the gravel slurry. The perforations within the conduit are typically spaced along the conduit length for uniform distribution of the gravel slurry.

Another embodiment is a method for completing a wellbore comprising extending a distribution tool having a plurality of outlets along its length into the wellbore. A sand control treatment is pumped through the plurality of outlets into the wellbore. The distribution tool can be removed from the wellbore. The distribution tool can also be releasably attached to a delivery tubing, and can be disconnected from the delivery tubing after pumping the sand control treatment. The removal of the distribution tool can also be achieved by the drilled out of the distribution tool.

BRIEF DESCRIPTION OF THE DRAWINGS

The manner in which these objectives and other desirable characteristics can be obtained is explained in the following description and attached drawings.

It is to be noted however, that the appending drawings illustrate only typical embodiments of this invention and are therefore not to be considered limiting of its scope, for the invention may admit to other equally effective embodiments.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1:
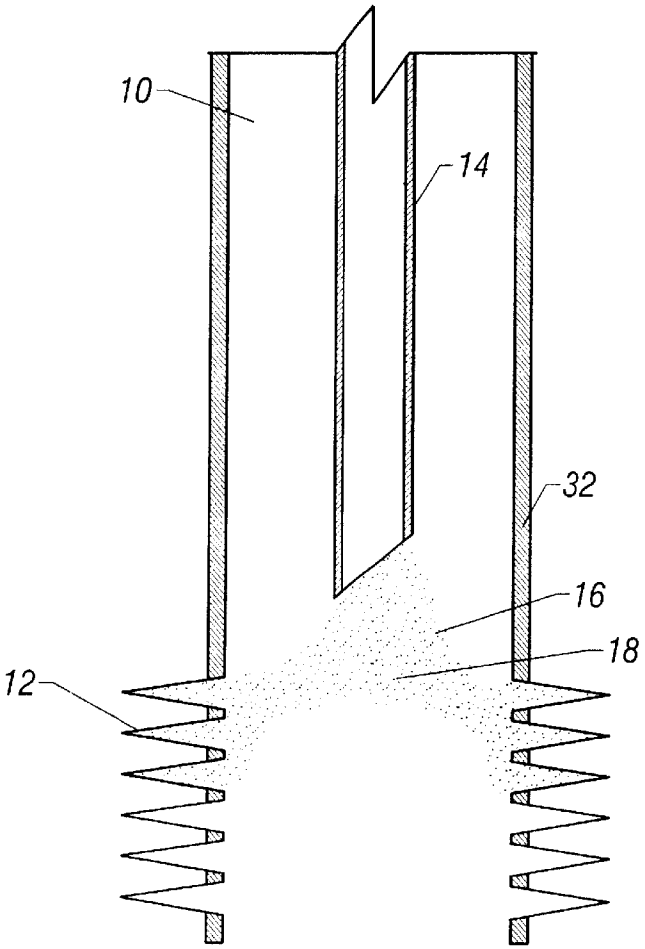
FIG. 1 (Prior Art)
FIG. 1 is a cross-sectional view of a well and illustrates a sand control operation resulting in a gravel bridge developing resulting in an incomplete treatment throughout the perforated zone. This figure is of the prior art.

FIG. 1 illustrates a wellbore 10 having a plurality of perforations 12 through the well casing 32. A tubing string 14 is inserted into the wellbore 10 and placed above the perforations 12. A gravel slurry 16 is pumped down the tubing string where it enters the wellbore 10 and some of the perforations 12, creating a gravel pack. FIG. 1 illustrates the problem where the slurry dehydrates after only a portion of the perforations have been packed. A bridge 18 of gravel forms within the wellbore 10, thus preventing any further gravel packing of the remaining perforations. When this occurs, the tubing string will be pulled from the well, the gravel bridge drilled out, and the process repeated until a satisfactory gravel pack has been achieved across the entire perforated interval. This same type of bridge 18 can form during a sand consolidation treatment if the sand and resin mixture 16 forms a bridge 18 and sets up prior to the filling of the wellbore 10 with the sand/resin mixture 16. The hardened sand/resin bridge 18 will then need to be drilled out and subsequent treatments performed.

The present invention provides a system using at least one conduit that is run into a well on a service string. The at least one conduit can be referred to as a distribution tool. The distribution tool can comprise many forms, for example, the conduits being attached to themselves, comprising separated channels within a single section of pipe, or can be bundled in some manner. A support element, such as a tubing section or a beam can also be included to increase the overall strength. The conduits can include outlets along its length to permit the gravel slurry to exit the conduit along the length of the conduit and distribute the gravel slurry the full length of the conduit.

Another embodiment of the distribution tool has multiple conduits that do not have outlets along their lengths but have an outlet at their ends. Conduits of varying lengths can then be used to provide outlets along the length of the distribution tool. The distribution tool can be referred to as simply a conduit, regardless of the number of individual conduits that may be included within the distribution tool. The conduit can have a plurality of outlets spaced along its length to provide an even distribution of the gravel pack and reduce the aforementioned problems. The conduits can also provide alternate flow paths of differing lengths that can provide flow paths at differing depths and a bypass around a gravel bridge that may have formed.

The conduit can be attached to the delivery tubing, for example, coiled tubing or service string tubing, via a releasable connector. The conduit is deployed on the delivery tubing in the well adjacent the area to be treated. The sand control treatment is pumped into the well. Once the treatment is complete, the releasable connector, if provided, can be released to disconnect the distribution tool from the delivery tubing. The delivery tubing can then be removed from the well. In alternative embodiments the distribution tool can be removed along with the delivery tubing after completion of the treatment. This would typically be done prior to the point of resin setup.

Figure 2:
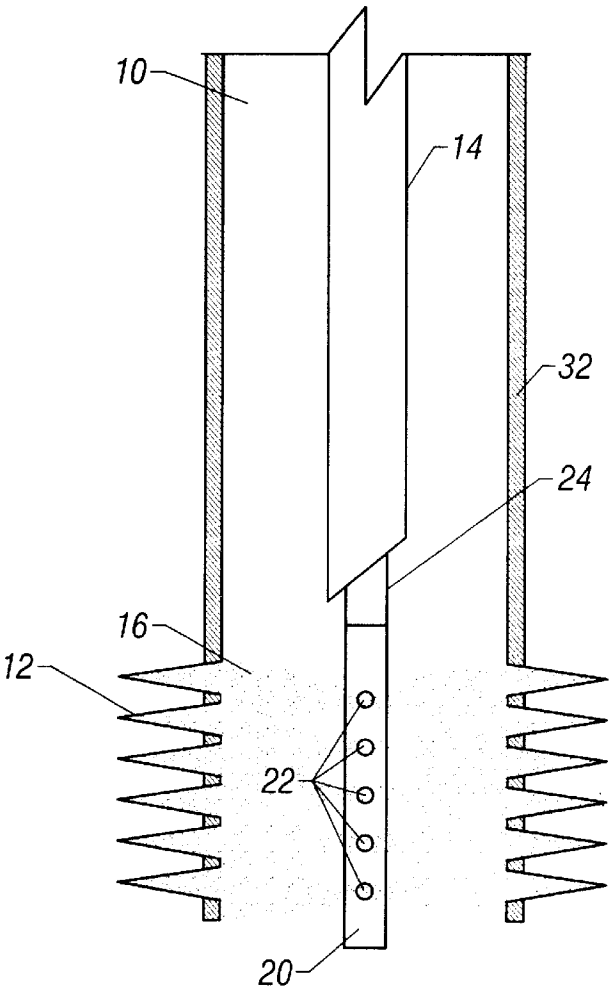
FIG. 2 is a cross-sectional view of a well and illustrates an embodiment of the invention used to avoid the creation of bridges.

FIG. 2 illustrates an embodiment of the invention in which a conduit 20 comprising a plurality of openings 22 is run into the wellbore on delivery tubing 24, also referred to as a work string. The conduit is placed adjacent to the perforations 12 and the sand control material 16 pumped through the conduit 20, providing a treatment across all of the perforations 12.

Figure 3:
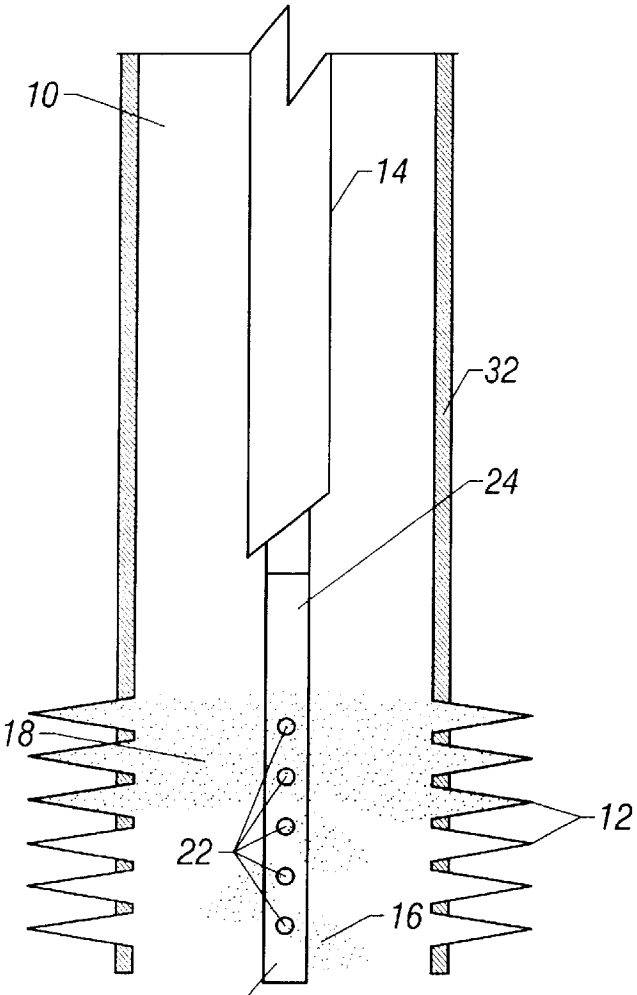
FIG. 3 is a cross-sectional view of a well and illustrates how the invention can bypass a bridge that has already formed within the wellbore.

FIG. 3 illustrates a situation in which a bridge 18 develops while using the conduit 20. The sand control material 16 is able to bypass the bridge 18 through the multiple openings 22 within the conduit 20, thereby depositing sand control material 16 below the bridge 18 and continuing the operation.

Figure 4:
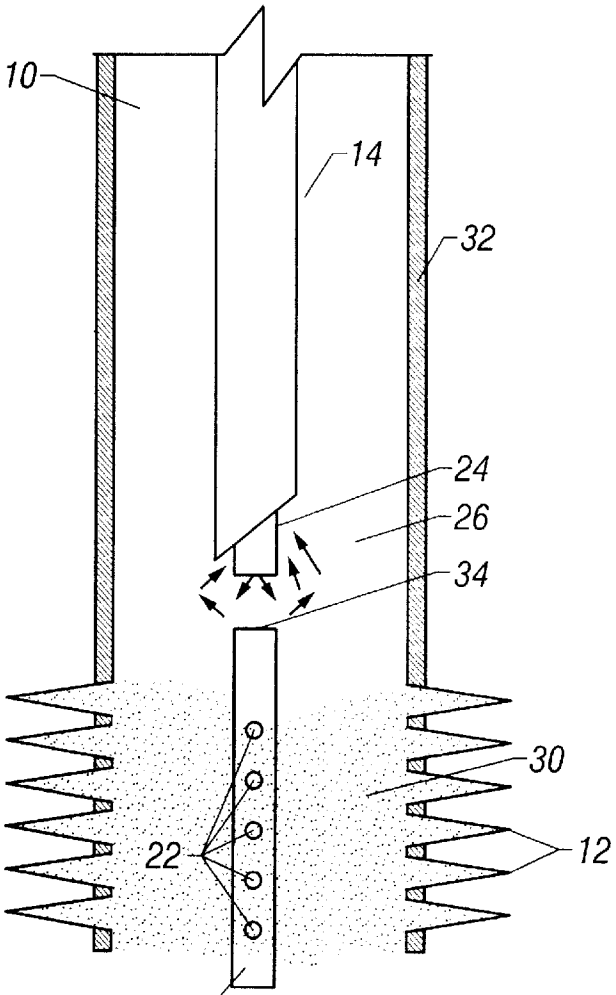
FIG. 4 is a cross-sectional view of a well and illustrates how the conduit can release from the delivery tubing and excess slurry can be circulated out of the wellbore.

FIG. 4 illustrates how the conduit 20 can release from the delivery tubing 24. This illustration shows how after a successful sand control treatment 30 has been deposited across the perforations 12, the delivery tubing 24 can release from the conduit 20 by means of a releasable connector 34 and any excess sand control material can be circulated (shown generally as the arrows labeled 26) out of the wellbore 10. The delivery tubing and/or any other tubing string 14 can then be removed from the wellbore 10 if desired. The releasable connector 34 can comprise any type of connection that can be released upon a certain action being taken, for example, a shear element, a J-slot, ball drop, or other mechanical or hydraulic type release mechanism. Another method of separating the conduit 20 from the delivery tubing 24 involves an explosively actuated release mechanism, such as those used in the Schlumberger WXAR—Wireline Automatic Gun Disconnect method. In one embodiment of this type method, the detonation of an explosive element, such as a primer cord, damages a retaining element within the connector, thus enabling the subsequent movement of release fingers, leading to the separation of the connection member. Other embodiments can include the use of a break plug that, prior to its destruction, is used to retain a release piston in a first position. The release piston can be spring loaded by a spring element that urges the release piston towards a second position. After the destruction of the break plug, the release piston shifts to a second position and allows the separation of an upper section of the connector from a lower section of the connector.

Figure 5:
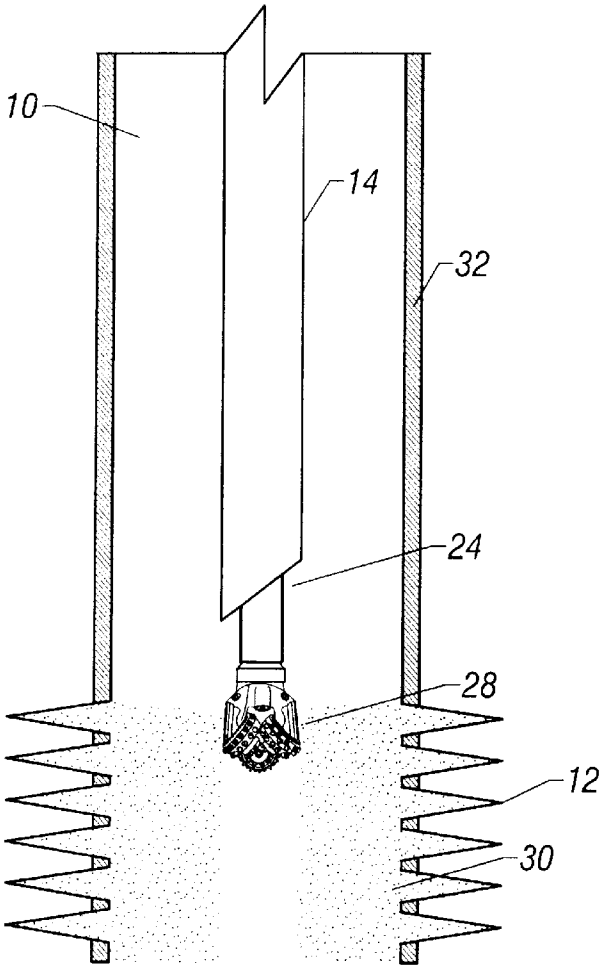
FIG. 5 is a cross-sectional view of a well and illustrates one method of removing the conduit from the well after the gravel pack is completed.

FIG. 5 shows the ability to run in the wellbore 10 with drilling tools 28 and drill out the conduit and a portion of the sand control treatment 30 from the wellbore 10. To facilitate the drilling out of the conduit, it can be made of a material that is easily drillable. Examples of materials that are easily drilled out include soft metal such as aluminum, plastics, fiberglass, and other composite materials. In this application the term "easily drillable material" refers to any material that is capable of being drilled into pieces with less force than it would take to drill out the material used for the well casing 32. In this way the conduit will drill into pieces rather than deflect the drilling tools 28 into the casing 32. Some materials, such as aluminum or certain plastics, can be made easier to drill out with the use of acid. Some materials, for example, certain plastics, can be dissolved with acid and removed by methods other than drilling.

As can be seen in FIGS. 2–5, the conduit 20 and drilling tools 28 can be run on a delivery tubing 24 through another tubing string 14, if desired. Utilizing an inner/outer tubing arrangement facilitates the circulation 26 of excess sand control material out of the well and reduces the risk of getting a tubing string stuck in the well. Referring to FIG. 4, if during circulation a bridge formed within the annulus between the tubing 14 and the delivery tubing 24, the bridge may prohibit the removal of the delivery tubing 24 from the wellbore 10. If this occurred, the tubing 14 could be removed from the wellbore 10, thereby bringing the delivery tubing 24 out also.

In some embodiments of the invention nozzles are placed within the outlets to provide a known diameter restriction. The nozzles act to impose an increased pressure drop across the outlet that will inhibit the tendency of the slurry to dehydrate and/or bridge within the conduit during a sand control treatment. Baffle elements may also be included in the interior of the conduit. The baffles act to induce turbulence within the conduit during a sand control treatment and will reduce the chances of bridging or premature dehydration. Within this application the term "increased pressure drop" and "elevated pressure drop" refers to a condition in which the pressure drop associated with an embodiment of the present invention is greater than the pressure drop that is associated with the prior art or a tool not having the aspect of the present invention. For example, the restrictive nozzles mentioned above that are placed within the outlets will act to impose a greater pressure drop than outlets that do not have nozzles located within them. The nozzles are capable of having differing sizes, depending on the desired pressure drop to be imposed. The nozzle sizes can vary along the length of the conduit and can also vary in relation to the radial placement of the nozzle around the conduit. It is possible to vary the nozzle sizes to impose a desired pressure drop profile along the conduit length or radially around the conduit.

Figure 6:
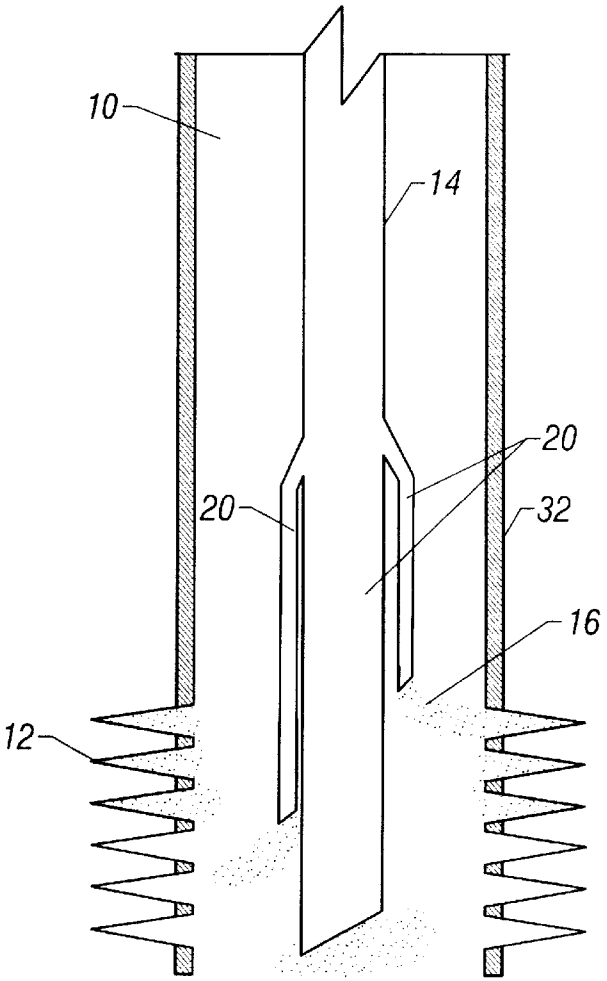
FIG. 6 is a cross-sectional view of a well and illustrates an alternate embodiment of the invention.

FIG. 6 shows an alternate embodiment of the invention comprising a plurality of conduits 20 that provide flow paths to differing depths within the wellbore 10. In this embodiment, if a bridge develops restricting the flow through one conduit 20, the treatment can proceed through one or more of the other conduits 20. The conduits 20 can be in fluid communication with the delivery tubing 14 and provide multiple flowpaths to cover the perforated interval 12. The conduits 20 can be connected or bundled together, such as by welding or bands, to provide increased strength, and can also be bundled to a support element (not shown) such as a pipe or beam, that provides increased strength.

Figure 7:
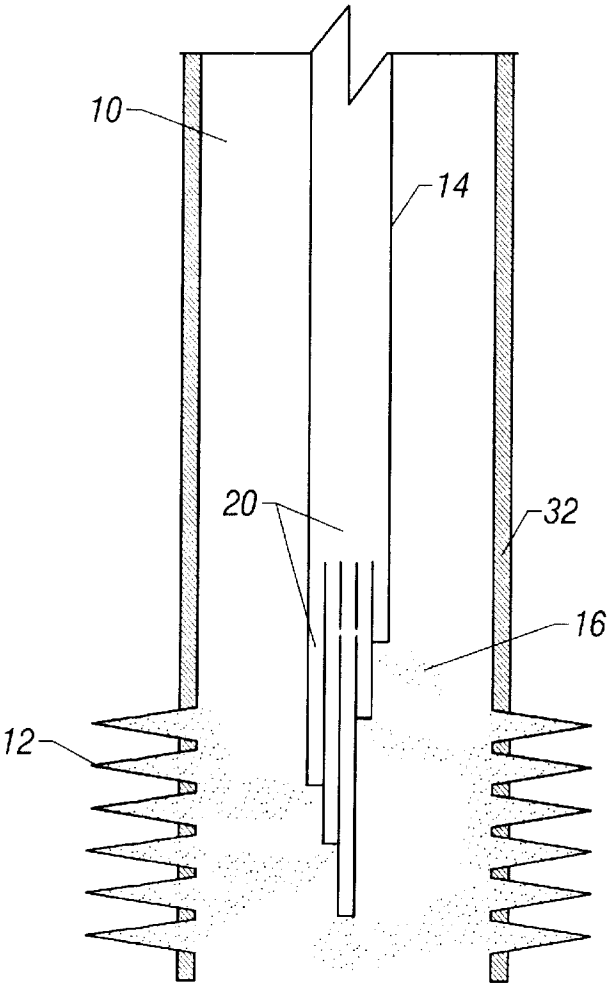
FIG. 7 is a cross-sectional view of a well and illustrates an alternate embodiment of the invention.

FIG. 7 shows another alternate embodiment of the invention comprising a plurality of conduits 20 that provide flow paths to differing depths within the wellbore 10. In this embodiment the conduits 20 comprise segments that extend from the delivery tubing.

Figure 8:
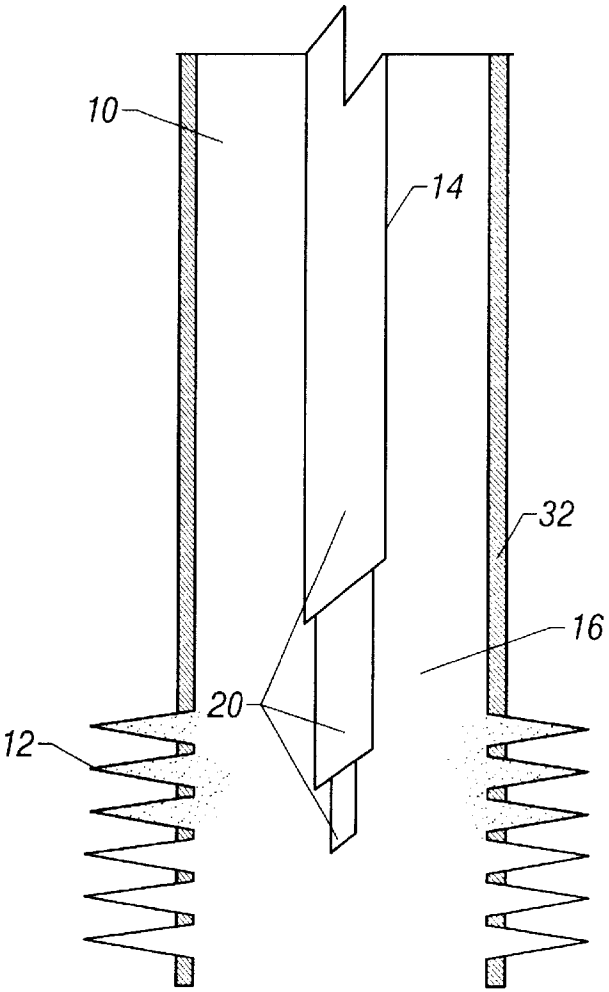
FIG. 8 is a cross-sectional view of a well and illustrates an alternate embodiment of the invention.

FIG. 8 shows another alternate embodiment of the invention comprising a plurality of conduits 20 that provide flow paths to differing depths within the wellbore 10. The conduits can be concentric or eccentric in relation to each other. In this illustration the conduits 20 comprise multiple concentric tubular sections that extend from the delivery tubing. Each concentric conduit 20 is in fluid communication with the delivery tubing.

The various embodiments of the present invention, such as shown in FIGS. 6–8, can be run with or without a releasable connector and can comprise nozzles spaced within the walls and located along the length of the conduits. The releasable connector is shown in FIG. 4.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

While the foregoing is directed to specific embodiments of the present invention, other and further embodiments of the invention may be devised without departing from the basic scope thereof, and the scope thereof is determined by the claims, which follow. It is the express intention of the applicant not to invoke 35 U.S.C. §112, paragraph 6, for any limitation of any of the claims herein, except for those in which the claim expressly uses the word "means" together with an associated function.

What is claimed is:

1. A sand control system for completing a wellbore, comprising:

a distribution tool comprising at least one conduit providing a plurality of outlets along the distribution tool length, such that the plurality of outlets are capable of allowing a gravel slurry to pass therethrough into the wellbore;

a delivery tubing extending to a well surface; and a releasable connector releasably connecting the distribution tool to the delivery tubing, such that the distribution tool may be released from the delivery tubing after a gravel packing operation, wherein:

the distribution tool is in fluid communication with the delivery tubing;

the distribution tool comprises a plurality of flow paths through the distribution tool to differing depths within the wellbore; and the distribution tool comprises a plurality of concentric tubulars forming a plurality of flow paths to differing depths within the wellbore.

2. A method for gravel packing a well, comprising:

extending a screenless gravel pack apparatus comprising a conduit having a plurality of outlets along its length in a well adjacent a portion of the well to be gravel packed, the conduit releasably attached to a delivery tubing;

pumping a gravel pack through the plurality of outlets into the well; and releasing the conduit from the delivery tubing.

3. The method of claim 2, further comprising:

removing at least a portion of the conduit and gravel pack from the well by drilling or breaking the conduit into a plurality of sections.

4. A method for gravel packing a well, comprising:

extending a conduit having a plurality of outlets along its length in a well adjacent a portion of the well to be gravel packed, the conduit releasably attached to a delivery tubing;

pumping a gravel pack through the plurality of outlets into the well;

releasing the conduit from the delivery tubing; and circulating excess gravel pack out of the well through the delivery tubing after releasing the conduit from the delivery tubing.

5. A method of completing a well, comprising:

pumping a gravel slurry through a conduit of a screenless gravel pack apparatus, the conduit being perforated along its length, wherein the perforated conduit is located in the well at a predetermined location within the well; and attaching the perforated conduit to a work string with a releasable connector.

6. The method of claim 5, further comprising:

placing the perforated conduit adjacent to perforations in a well casing.

7. The method of claim 5, further comprising:

releasing the perforated conduit from the work string after pumping the gravel slurry.

8. The method of claim 7, further comprising:

drilling out the perforated conduit after releasing the perforated conduit from the work string.

9. A method for completing a wellbore, comprising:

extending a screenless distribution tool having a plurality of outlets along its length into the wellbore; and pumping a sand control treatment through the plurality of outlets into the wellbore.

10. The method of claim 9, wherein the distribution tool is releasably attached to a delivery tubing.

11. The method of claim 10, wherein the distribution tool is disconnected from the delivery tubing after pumping the sand control treatment.

12. The method of claim 9, further comprising:

removing the distribution tool from the wellbore.

13. The method of claim 9, further comprising:

drilling out the distribution tool.

* * * * *